US006735793B2

(12) United States Patent
Peterson

(10) Patent No.: US 6,735,793 B2
(45) Date of Patent: May 18, 2004

(54) WATER CONTAINMENT BLOCK

(76) Inventor: Edward T. Peterson, 1002 E. Southfork Dr., Draper, UT (US) 84020

( * ) Notice: Subject to any disclaimer, the term of this patent is extended or adjusted under 35 U.S.C. 154(b) by 0 days.

(21) Appl. No.: 10/098,265

(22) Filed: Mar. 14, 2002

(65) Prior Publication Data

US 2003/0172453 A1 Sep. 18, 2003

(51) Int. Cl.[7] ..... A47K 3/22

(52) U.S. Cl. ..... 4/613; 4/600; 4/612; 4/614; 4/609; 4/596

(58) Field of Search ..... 4/613, 614, 596, 4/609, 612, 600

(56) References Cited

U.S. PATENT DOCUMENTS

| | | | | | |
|---|---|---|---|---|---|
| 2,757,385 A | | 8/1956 | Whittick | 4/146 |
| 3,451,178 A | | 6/1969 | Beale | 52/210 |
| 3,800,335 A | | 4/1974 | Buonaura | 4/146 |
| 4,473,911 A | | 10/1984 | Germain | 4/609 |
| 4,551,870 A | | 11/1985 | Presti, Jr. | 4/613 |
| 4,557,004 A | | 12/1985 | Piana | 4/613 |
| 5,092,002 A | * | 3/1992 | Powers | 4/596 |
| 5,657,581 A | * | 8/1997 | Husting | 49/409 |
| 5,845,347 A | | 12/1998 | Young | 4/613 |
| 6,006,375 A | * | 12/1999 | Carr | 4/613 |
| 6,094,757 A | | 8/2000 | Torres | 4/613 |
| 2002/0157325 A1 | * | 10/2002 | Domanico | 52/35 |

* cited by examiner

*Primary Examiner*—Henry Bennett
*Assistant Examiner*—Azy Kokabi
(74) *Attorney, Agent, or Firm*—Lloyd W. Sadler

(57) ABSTRACT

A prefabricated block for use in the construction of water containment areas, such as showers, tubs, pools and the like is provided. This block is designed to facilitate rapid, consistent construction while maintaining maximum water containment. In preferred embodiments, this block has a sloped surface for water-shedding as well as a slot for receiving the pan or liner.

2 Claims, 7 Drawing Sheets

WATER CONTAINMENT BLOCK

BACKGROUND OF INVENTION

1. Field of the Invention.

This invention relates to building materials blocks. More specifically, this invention relates to building materials blocks used in the construction of water containment enclosures.

2. Description of Related Art.

A variety of building materials and techniques are used and well known in the construction of water containment enclosures, such as showers, bathtubs, saunas, and hot tubs. Generally, these prior materials and techniques involve the use of wood products, which eventually fail due to mildew, warping, and leakage, and/or involve the use of custom poured cement, which use is time consuming, expensive to pour and to remove, and subject to cracking.

The reader is referred to the following U.S. patent documents for general background material, each of which is hereby incorporated by reference in its entirety for the material contained therein.

U.S. Pat. No. 6,094,757 describes a threshold assembly to be used with a conventional barrier free shower.

U.S. Pat. No. 5,845,347 describes a shower foundation having a curb formed as an integral part of the base.

U.S. Pat. No. 5,092,002 describes a shower base having a threshold formed by long plastic members over a 2×4 lumber base.

U.S. Pat. No. 4,557,004 describes a prefabricated shower module.

U.S. Pat. No. 4,551,870 describes a shower stall threshold composed of two opposed forms of plastic whereby mortar is poured in-between to stabilize the threshold.

U.S. Pat. No. 4,473,911 describes a water dam for preventing water from running over a bathtub enclosure having facilities for showering.

U.S. Pat. No. 3,800,335 describes a prefabricated shower receptor.

U.S. Pat. No. 3,451,178 describes a seal for the joint between the threshold and posts of a shower stall door.

U.S. Pat. No. 2,757,385 describes a prefabricated shower receptor.

Presently, the most common method of producing a quality shower threshold is to position forms on either side of proposed curb and positioning the forms in the precise alignment so as to have the end product plumb on both the front and the back sides, level across the top lengthwise, and with a slope on the top to facilitate draining excess water toward the front of the curb back into the water containment area. The pan is positioned in-between the forms so as to keep the pan in a continuous vertical position around the water containment area. The area between the forms is then filled with cement. The installer must then wait for the cement to cure, which time is typically at least twelve hours, before finish materials can be installed. The resulting cement form may then be finished with tile or other finishes as may be desired. The quality, including straightness, strength, water resistance and durability, of the resulting product may vary greatly depending on the skill and practices of the persons forming the curb.

A number of problems may arise during this process. The curb is usually installed after the surrounding walls are finished and painted, which prevents the forms from being nailed or screwed to the walls to hold them in place, without damaging paint and walls on the outside of the shower area. This problem also occurs on the inside of the shower where the pan runs around the perimeter of the shower, wherein if the form is attached with nails or screws the pan must be punctured, thereby creating a susceptibility for leaks from the pan. To avoid having to make these damaging attachments to the wall, most installers will use a heavy item, such as a box of tile, bag of cement, brick and the like, placed up against the forms on either side to hold the forms in place. This is not an easy or reliable method for keeping the forms in place, since it is common that the forms will slip out of position by the weight of the cement as it is poured, resulting in a finished curb that is not plumb, level, of uniform width or which has the proper slope on the top of the curb. Therefore, the completed resulting enclosure is likely to be subject to undesirable leaks.

An additional problem with poured cement curbs is that it is common for there to be a size difference between sites. This size difference, from site to site, means the forms may not work in successive sites, leading to additional excessive expense for forms. Also, time is wasted as new forms are made and installed, especially if the curb is to have a corner or a radius.

An inferior, but not uncommon, method of constructing a water containment curb, generally taught by "do it yourself" books and videos, is to build the curb out of wood, wrapping the pan up the front and over the top of the wood curb. The pan and wood are then wrapped with metal lathe and a brown coat of typically ½ inch of cement is deposited thereon. This method also requires a cure time of many hours. Sometimes, an inexperienced installer will replace the metal lathe and brown coat with a prefabricated cement board or even sheetrock. In each of these approaches, staples, nails or other fasteners are required to attach the metal lathe, thereby puncturing the pan. Water then infiltrates the structure, leading to wood rot, mildew, sweating, contraction, warping, and water containment failure.

SUMMARY OF INVENTION

It is desirable to have a prefabricated block adapted specifically for use in the construction of water containment structures in homes. Such water containment structures are used in the construction of showers, bathtubs, saunas, hot tubs, pools and the like. It is particularly desirable to have a prefabricated block that is provided with structure for holding a pan or liner in place and which facilitates the construction of a curb, for containing water, that has a sloped top surface.

Therefore, it is an object of this invention to provide a prefabricated block and a method whereby a water-resistant curb may be constructed having water-resistant qualities and long life.

It is another object of this invention to provide a prefabricated block that can be used to construct a water-resistant curb with a reduced amount of skilled labor.

It is a further object of this invention to provide a prefabricated block that can be used to construct a water-resistant curb while avoiding a lengthy curing period.

It is a still further object of this invention to provide method of constructing a water-resistant curb and providing a prefabricated block that can be used to construct a variety of water-resistant curbs with uniformity of shape and strength.

Another object of this invention is to provide a method of constructing a water-resistant curb and providing a prefabricated block the use of which avoids the need for pouring cement materials.

A further object of this invention is to provide a method of constructing a water-resistant curb and a prefabricated curb block that includes features for holding a pan or liner in position.

A still further object of this invention is to provide a method of constructing a water-resistant curb and a prefabricated curb block wherein the use of nails, staples, screws and other piercing fasteners into pans and walls is reduced or eliminated.

Additional objects, advantages, and other novel features of this invention will be set forth in part in the description that follows and in part will become apparent to those skilled in the art upon examination of the following or may be learned with the practice of the invention. The objects and advantages of this invention may be realized and attained by means of the instrumentalities and combinations particularly pointed out in the appended claims. Still other objects of the present invention will become readily apparent to those skilled in the art from the following description wherein there is shown and described the preferred embodiments of this invention, simply by way of illustration of one of the modes best suited to carry out this invention. As it will be realized, this invention is capable of other different embodiments, and in its several details it is capable of modification without departing from the concept of the invention. Accordingly, the drawings and descriptions should be regarded as illustrative in nature and not as restrictive.

BRIEF DESCRIPTION OF DRAWINGS

The accompanying drawings incorporated in and forming a part of the specification, illustrate a preferred embodiment of the present invention. Some, although not all, alternative embodiments are described in the following description. In the drawings.

Figure 1A:
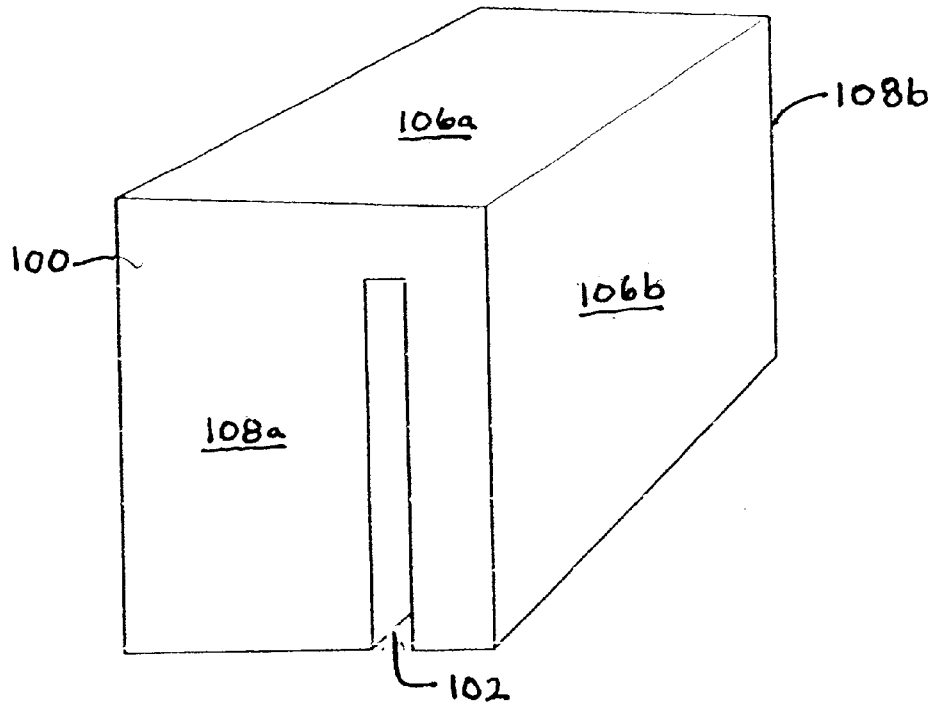
FIGS. 1*a* and 1*b* show perspective views of an example curb block of the invention.

Reference will now be made in detail to the present preferred embodiment of this invention, an example of which is illustrated in the accompanying drawings.

DETAILED DESCRIPTION

This invention includes prefabricated blocks used in the construction of a curb for the perimeter of a water containment area. Preferably, the blocks are formed from a strong, rigid and generally water resistant substrate material, so that the blocks will withstand exposure to water and the weight of traffic encountered in the application environment. Appropriate, presently preferred, materials include cement, cinder block, foam, fiberglass, and/or ceramic. The blocks are typically designed to be high enough to create a barrier to hold backwater but not so high as to impede easy access to the water containment area by stepping over a curb constructed of such blocks. One present example of a water containment area or application environment is a shower. Other potential embodiments of the blocks of this invention include: pools, tubs, gutters, designed streambeds and the like. The blocks are preferably provided with a width which provides sufficient rigidity and stability and which is strong enough to withstand forces typically placed upon the brick in normal use. Apart from this, the blocks may, in alternative embodiments, have a width as is deemed to be desirable, practical, aesthetically pleasing or otherwise. In the present preferred embodiment, the blocks have a similar width to that of a standard framed wall, including sheetrock, typically 4.5 inches. A slot, typically running the length of the block is provided on the bottom of the block to receive a pan or liner. In a preferred embodiment the slot is vertical, although other slot orientations are functional, are envisioned as alternatives, and are considered within the scope of this invention. The blocks have a base surface, located at the bottom in a preferred embodiment, whereby the blocks may be attached to and held generally immovable by a fixed substratum. In a preferred embodiment, the base is generally horizontal, substantially flat, and textured to provide attachment by an adhesive such as mortar.

The blocks, in their typical configuration for forming a curb, are placed side by side with the slot in alignment so as to form a raceway or groove to receive a pan or liner vertically inside the curb, thereby forming a continuous wall at or near the perimeter of the water containment area. The blocks, therefore, have two mating surfaces for mating adjacent blocks in the run. In a preferred embodiment, the mating surfaces are perpendicular to the slot and the base, thereby giving the block an orthogonal appearance. In a preferred embodiment, the slot is approximately ½ inch wide and extends to approximately 1 inch from the top of the block. In a preferred alternative embodiment, the slot is enlarged at one end allowing the pan or liner lip to vary horizontally from the straight line of the curb, thereby allowing a tolerance in the position of the pan or liner as it proceeds out of a wall, as for example, between the framing and the sheeting. The top of the blocks is sloped so as to direct any moisture on the top of the blocks into the water containment area. The blocks are conceptually divided into a wet and a dry portion at the top of the block, the wet portion having a surface that sheds off water into the containment area and the dry portion not providing water protection to objects outside the containment area.

In a present preferred embodiment the block has a width of 4½ inches, a height of 5 7/16 inches to adjacent to the water containment area and a height of 5⅝ on the opposite side. In that embodiment, the top of the block is sloped at approximately 3 degrees. The blocks are typically provided in several lengths, thereby permitting a combination of sizes to be used to conform to a wide variety of required distances, but are not so long as to make the handling or installation of the blocks unduly cumbersome or difficult. In alternative embodiments, the blocks have mating surfaces at angles of 45 degrees and 22.5 degrees to enable a curb to turn a 90-degree or a 45-degree corner respectively without cutting the blocks. Other angles may be used as desired, and are intended to fall within the scope of this invention.

The curb block of the invention may be used at the perimeter of any water containment area needing a relatively small wall for the purpose of access to the area by stepping over the wall or for the purpose of viewing the containment area. In one configuration of this invention curb blocks are used in a shower creating a curb at a doorway. In another configuration of the invention curb blocks are used in a shower having a glass (or other wise generally transparent material) door and/or a wall. If the invention is intended to be used on a finished product that is plumb on the front and the back, the preferred curb block is level across the length of the curb and has the correct slope on the top for draining water toward the containment area. It is expected that a surface finish, such as tile, may be applied to the curb as soon as within one hour of construction using the blocks. It is also preferred that these curb blocks be made of a thermally stable material, so that expansion and contraction due to temperature variations do not pose a problem.

Figure 1B:
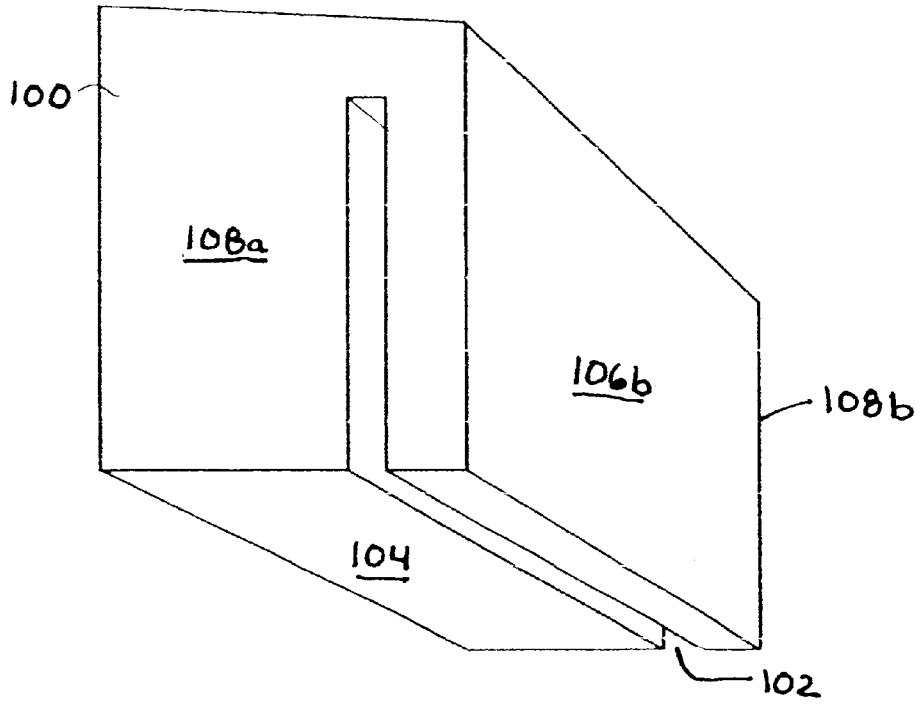

FIGS. 1*a* and 1*b* illustrate, by way of example, a curb block 100 of this invention. This curb block 100 is formed of a strong, rigid, generally water-resistant material. A slot 102 is provided in the block 100. The slot 102 is sufficiently wide to receive a pan or liner. A base 104 is provided for the block 100 whereby an attachment may be made to hold the block in position. Such an attachment may be made with mortar, construction adhesives, or other adhesives and attachment means as will be recognized by those skilled in the art. Slot 102 is shown perpendicular to base 104 in one configuration, although other angles and relationships of slot 102 and base 104 can be uses alternatively in other configurations and should be considered within the scope of this invention. A water-shedding surface, shown as two adjacent surfaces 106*a* and 106*b*, is provided in the block 100 such that water deposited on these water-shedding surfaces 106*a*, 106*b* will be directed to the water containment area when the block is placed in the proper installation orientation. Mating surfaces 108*a*, 108*b* (not visible in these views) are provided whereby an abutted succession of blocks may be placed in a line to span the distance of the required curb.

Figure 2A:
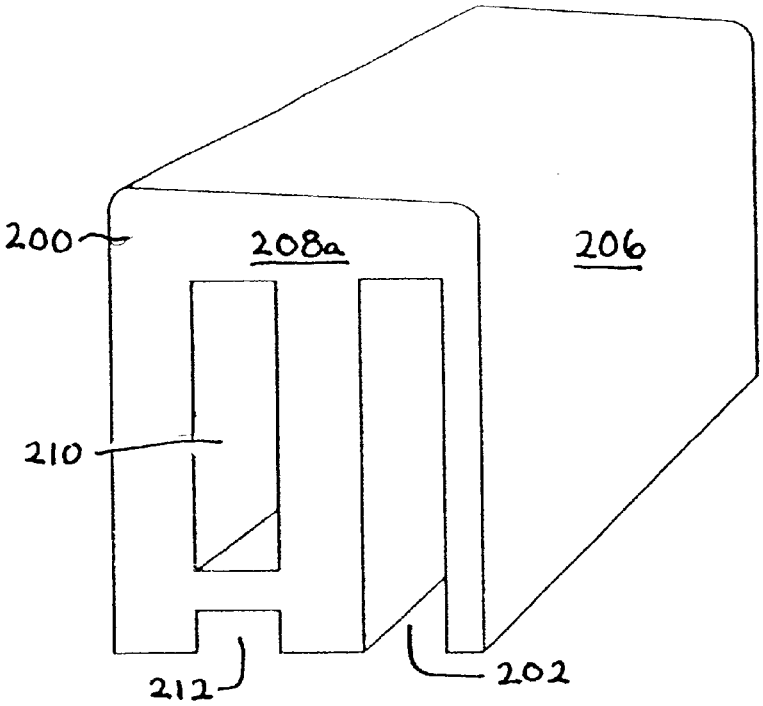
FIGS. 2*a*, 2*b*, 2*c* and 2*d* show perspective views of a preferred embodiment of a curb block of the invention.
Figure 2B:
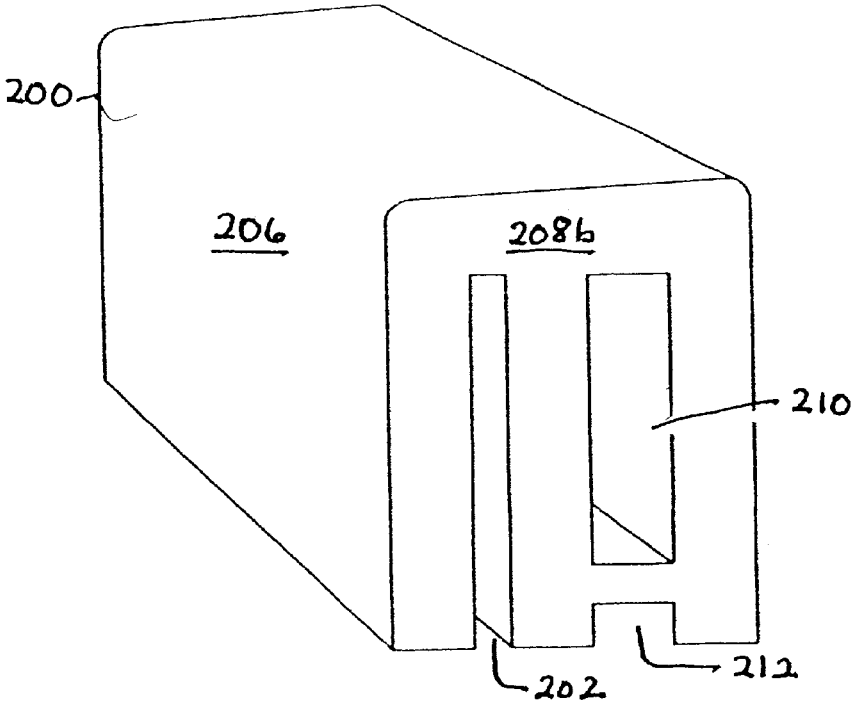
Figure 2C:
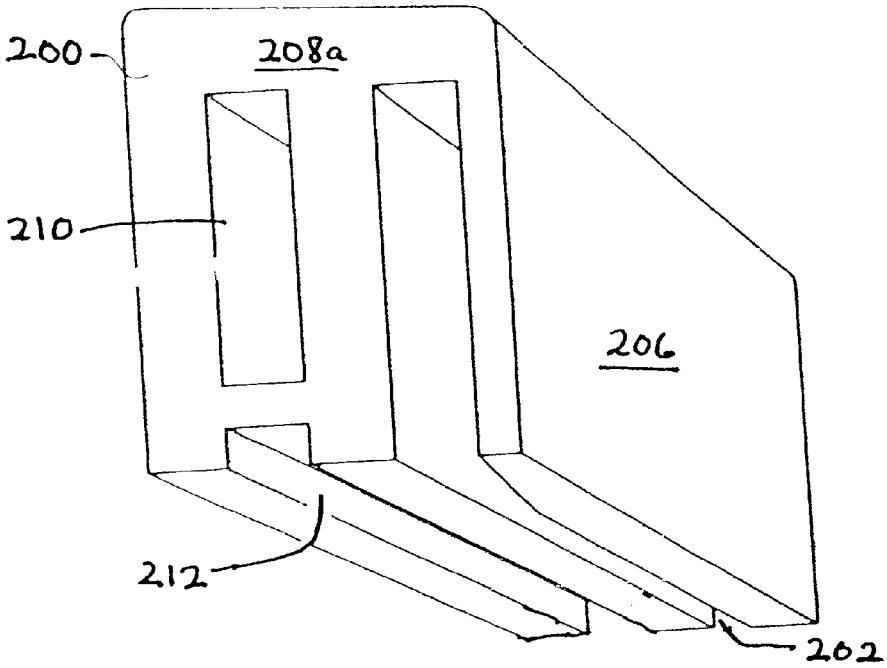
Figure 2D:
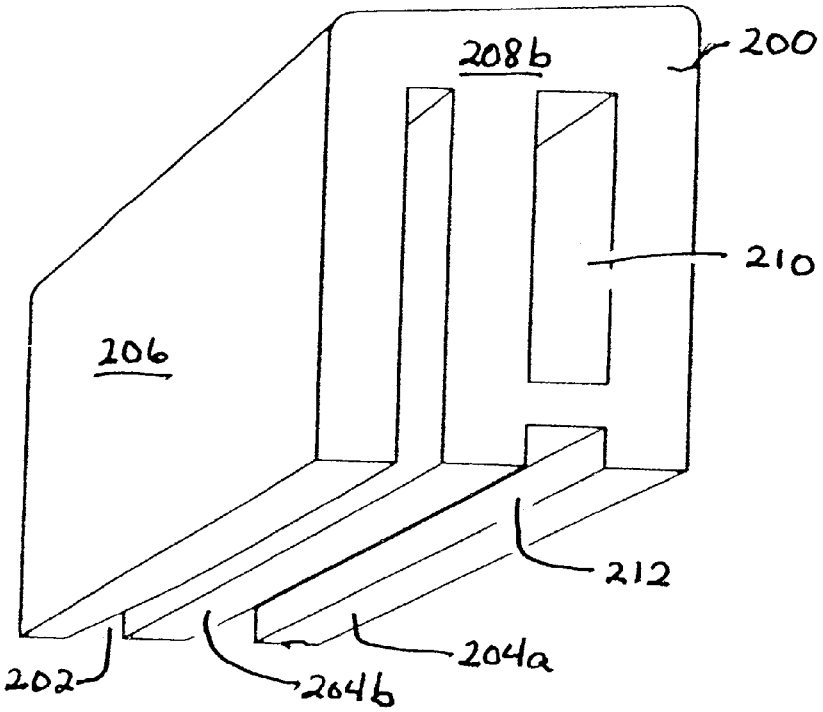
Figure 2E:
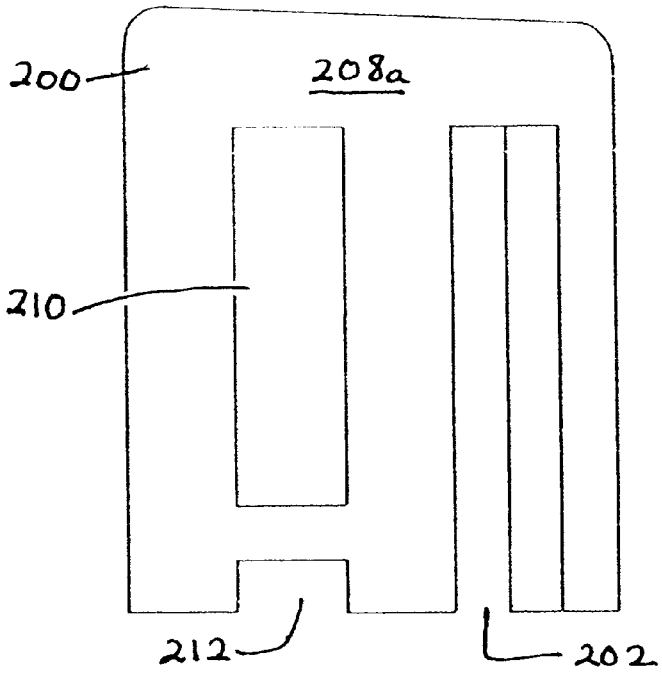
FIGS. 2*e* and 2*f* show a side view of a preferred embodiment of a curb block of the invention.
Figure 2F:
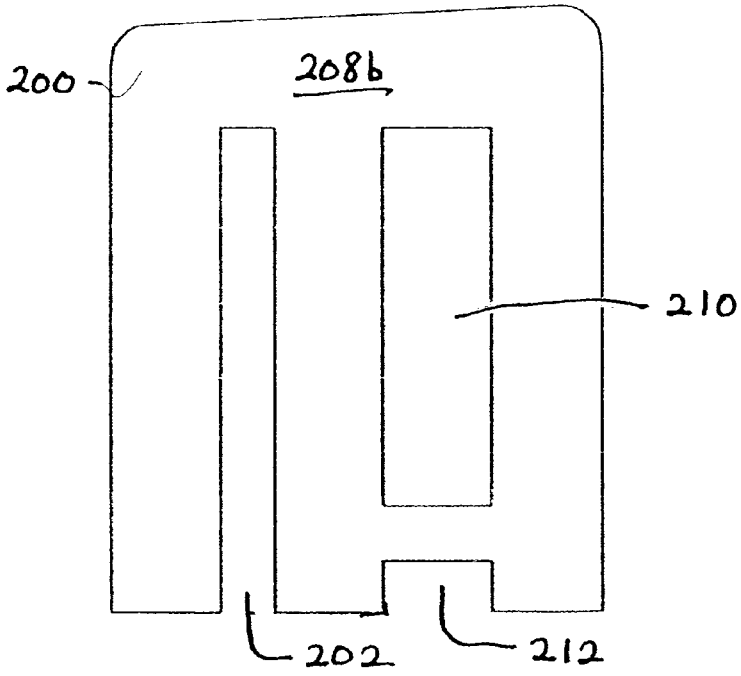
Figure 2G:
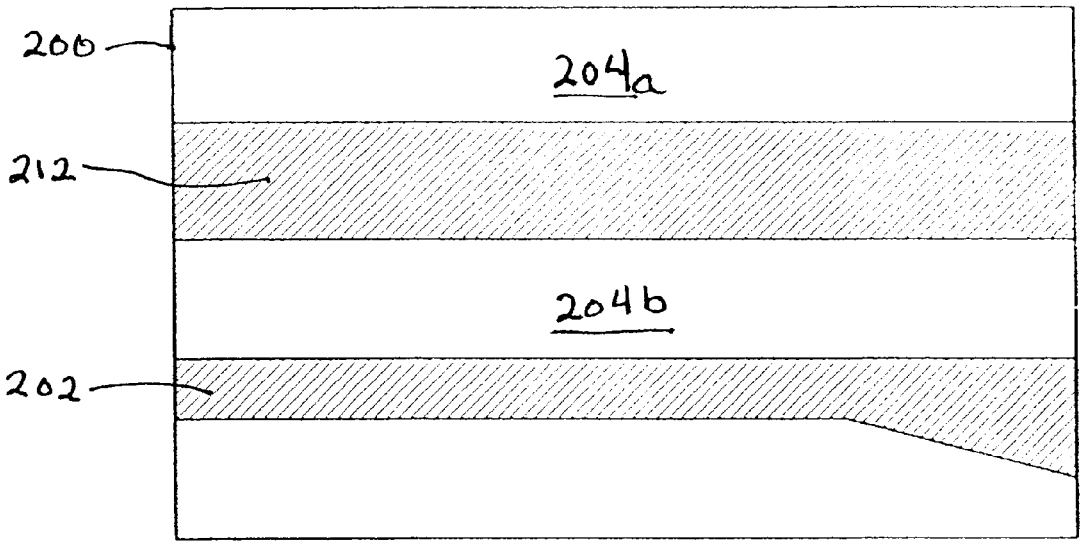
FIG. 2*g* shows a bottom view of a preferred embodiment of a curb block of the invention.
Figure 5:
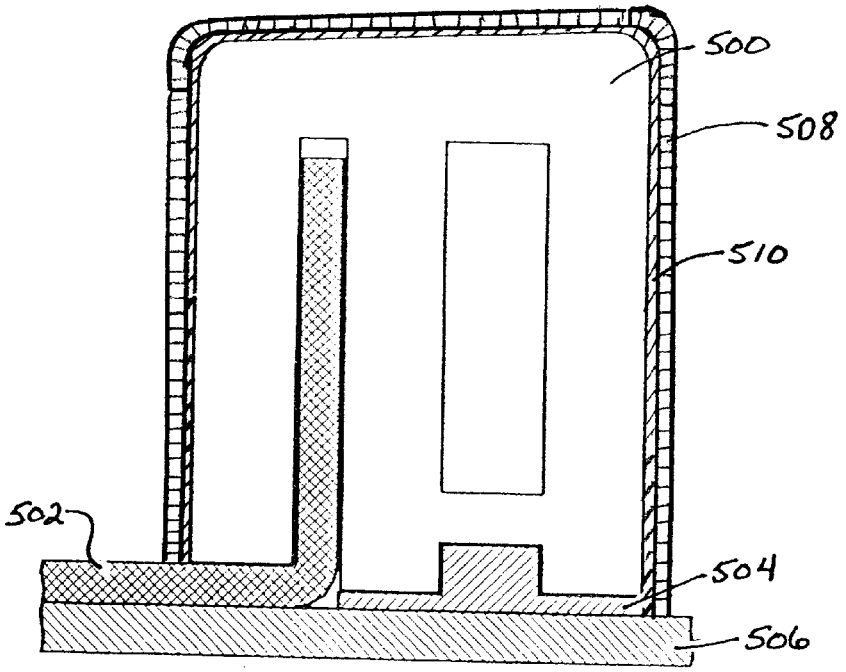
FIG. 5 illustrates by example an installed configuration of an example curb block.
Figure 6:
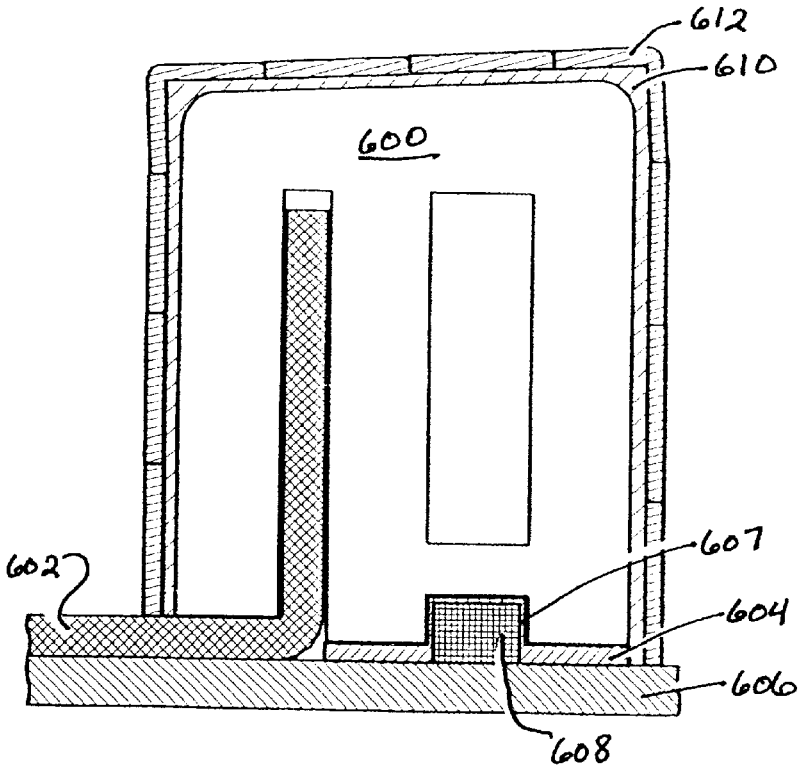
FIG. 6 illustrates by example another installed configuration of an example curb block.

FIGS. 2*a*, 2*b*, 2*c*, 2*d*, 2*e*, 2*f*, 2*g* illustrate by way of example a preferred embodiment of this invention. FIG. 2*a* shows a perspective view from above and to the right. FIG. 2*b* shows another perspective view, the block being rotated in the vertical axis approximately 140 degrees from the view of FIG. 2*a*. FIG. 2*c* shows a perspective view as FIG. 2*a*, but from below. FIG. 2*d* shows another perspective view, the block being rotated vertical axis approximately 140 degrees from the view of FIG. 2*c*. FIG. 2*e* shows a side view showing the same abutment face as FIGS. 2*a* and 2*c*. FIG. 2*f* shows a side view showing the same abutment face as FIGS. 2*b* and 2*d*. FIG. 2*g* shows a bottom view of that preferred embodiment. A curb block 200 is preferably formed of a strong, rigid, generally water-resistant material. A slot 202 is incorporated in block 200 sufficiently wide to receive a pan or liner. Slot 202 is widened at one end, thereby providing a horizontal tolerance in the position of the pan or liner lip, as may be useful for placement of the block as the liner or pan proceeds out of a wall, as described above. A base 204*a, b* is incorporated in block 200 whereby a permanent attachment may be made to hold the block in position. A water-shedding surface 206 is incorporated to block 200 such that water deposited to surface 206 will be directed to the water containment area when the block is placed in the proper installation orientation. Mating surfaces 208*a* and 208*b* are provided whereby an abutted succession of blocks may be placed in a line to span the distance of the required curb. A cavity 210 is provided to reduce the amount of material required to form each block. Further cavities may be included as desired in alternative embodiments, so long as they do not significantly compromise the strength and/or rigidity of the block. An alignment channel 212 is provided whereby the blocks may be aligned more precisely by placing an elongated object, such as a board in the channel 212. This alignment channel 212 may also serve to hold the blocks into its installed position. The alignment channel 212 may also serve to hold the blocks into their installed position. This alignment channel 212 is but one example of an alignment feature; other alignment features may be used, as will be understood by those skilled in the art, without departing from the scope of this invention. The exposed corners of the block of FIGS. 1*a* and 1*b* have been rounded in this embodiment to accept a radius bullnose, used in many ceramic tile applications. Generally, there are two different types of ceramic tile trims: a radius bullnose and a surface bullnose. An example of a curb block of this invention with a radius bullnose ceramic trim is shown in FIG. 5. An example of a curb block of this invention with a surface bullnose surface trim is shown in FIG. 6.

Figure 3:
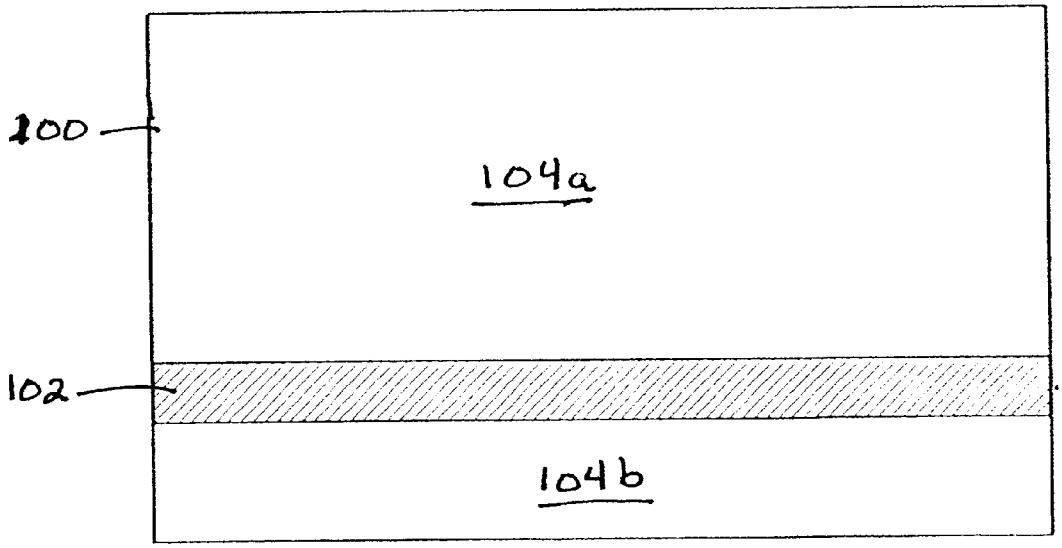
FIG. 3 shows a bottom view of an example curb block of the invention.

FIG. 3 shows a bottom view of the curb block 100 of FIGS. 1*a* and 1*b*.

Figure 4:
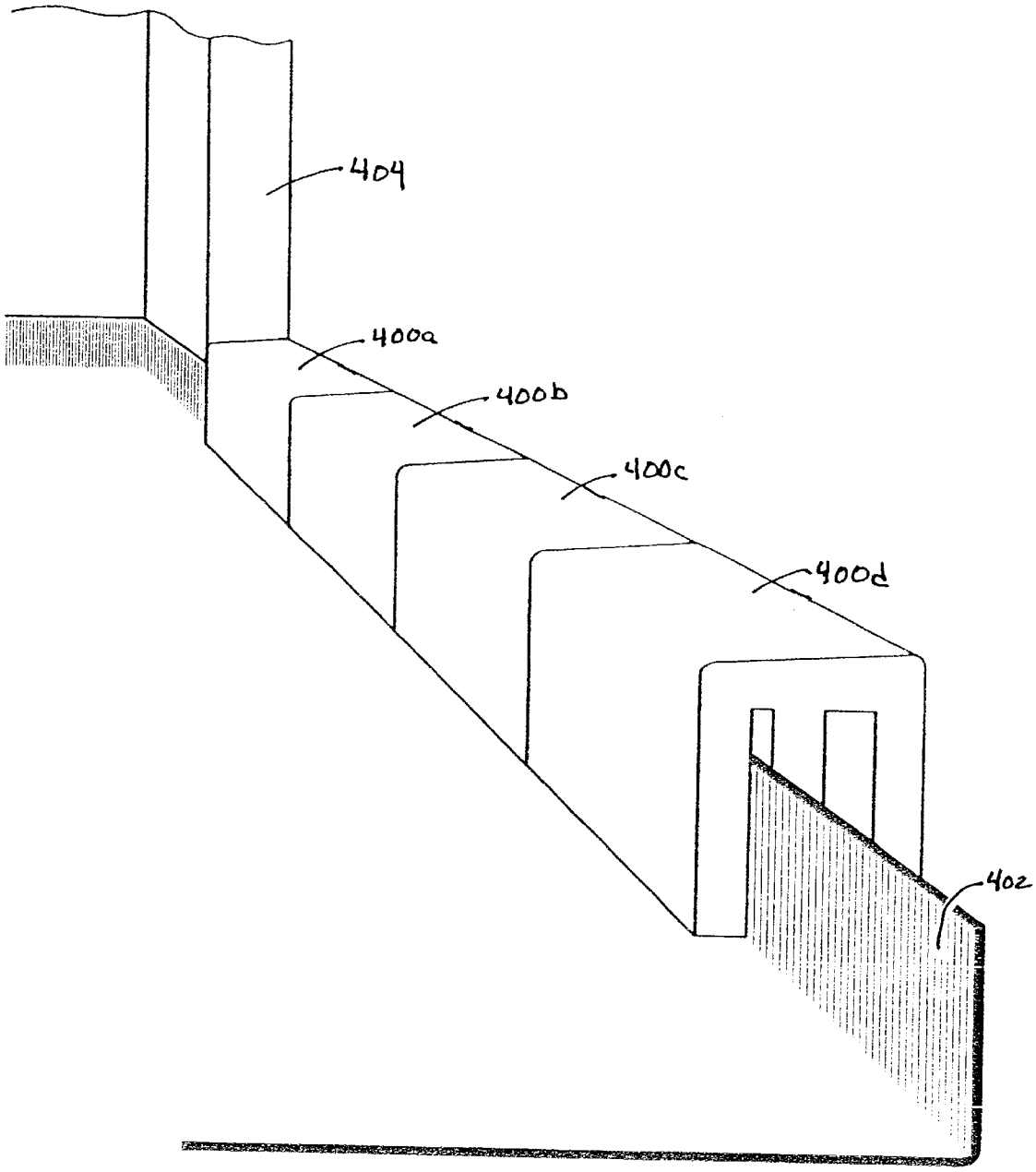
FIG. 4 illustrates by example an installation configuration of curb blocks along a straight run.

FIG. 4 illustrates by example an installation configuration of curb blocks along a straight run. Curb blocks 400*a–d* are placed in an aligned fashion. A pan or liner 402 has been inserted in the slot in the curb blocks 400*a–d*. A wall 404 terminates the run; the liner 402 and one end block 400*a* meets at the wall intersection.

FIG. 5 illustrates by example an installed configuration of one embodiment of a curb block 500. The curb block 500 receives a pan or liner 502. The pan or liner 502 rests on a substratum 506. Examples of a substratum 506 are a concrete floor and a plywood subfloor. The curb block 500 is adhered at the base to substratum 506 through adhesive 504. One example of an adhesive 504 is mortar. The installation can be finished, as shown here, by tiles 508 adhered with a thinset adhesive 510. The surface trim provided by the tiles 508 here is an example of a radius corner trim.

FIG. 6 illustrates by example another installed configuration of an embodiment of a curb block 600. The curb block 600 receives a pan or liner 602. The pan or liner 602 rests on a substratum 606. The curb block 600 is aligned to a guide 608 through a channel 607 formed therein. Examples of a guide 608 are a board or an elongated sheet metal or plastic metal. The curb block 600 is adhered at the base to substratum 606 through adhesive 604, one example being mortar. Furthermore, in this example, the installation is finished with tiles 612 adhered with a thinset adhesive 610. The surface trim provided by the tiles 612 is an example of application on block corners.

As will be recognized by those skilled in the art, other installation configurations are possible. These installation configurations are provided as enabling examples only. Further techniques for installing curb blocks, as well as certain alternative configurations of curb blocks, are considered to be within the scope of this invention. While the present invention has been described and illustrated in conjunction with a number of specific embodiments, those skilled in the art will appreciate that variations and modifications may be made without departing from the principles of the inventions as herein illustrated, described and claimed. This invention may be embodied in other forms and shapes without departing from the scope and spirit of this invention. The described embodiments are to be considered in all respects as only illustrative and not as restrictive. The scope of this invention is, therefore, indicated by the appended claims, rather than the foregoing description. All changes that come within the meaning and range of equivalency of the claims are to be embraced as being within their scope.

What is claimed is:

1. A curb block for water containment thresholds, comprising:

(A) a substrate of formed material, said substrate having installation orientation;

(B) a base surface in said substrate, said base surface being conductive to permanent attachment;

(C) a slot in said base of said substrate, said slot having a width appropriate for the insertion of a liner;

(D) a water-shedding surface on said substrate, said water-shedding surface having a slope such that water is naturally directed from said water shedding surface;

(E) a first mating surface and a second mating surface for use in abutting a plurality of said blocks end-to-end; and one or more cavities within said substrate.

2. A curb block for water containment thresholds, comprising:

(A) a substrate of formed material, said substrate having installation orientation;

(B) a base surface in said substrate, said base surface being conductive to permanent attachment;

(C) a slot in said base of said substrate, said slot having a width appropriate for the insertion of a liner;

(D) a water-shedding surface on said substrate, said water-shedding surface having a slope such that water is naturally directed from said water shedding surface;

(E) a first mating surface and a second mating surface for use in abutting a plurality of said blocks end-to-end; and (F) an alignment feature formed in said substrate, said alignment feature providing a means of aligning said first mating surface and said second mating surface.

* * * * *